US011062671B1

(12) United States Patent
Xue

(10) Patent No.: US 11,062,671 B1
(45) Date of Patent: Jul. 13, 2021

(54) PIXEL DRIVING CIRCUIT, DRIVING METHOD THEREOF AND LIQUID CRYSTAL DISPLAY PANEL

(71) Applicant: Shenzhen China Star Optoelectronics Semiconductor Display Technology Co., Ltd., Guangdong (CN)

(72) Inventor: Yan Xue, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/766,756

(22) PCT Filed: May 12, 2020

(86) PCT No.: PCT/CN2020/089816

§ 371 (c)(1),
(2) Date: May 26, 2020

(30) Foreign Application Priority Data

Mar. 5, 2020 (CN) ..... 202010146673.3

(51) Int. Cl.
*G09G 3/36* (2006.01)

(52) U.S. Cl.
CPC ..... *G09G 3/3688* (2013.01); *G09G 3/3677* (2013.01); *G09G 2300/0876* (2013.01); *G09G 2330/021* (2013.01)

(58) Field of Classification Search
CPC combination set(s) only.
See application file for complete search history.

(56) References Cited

U.S. PATENT DOCUMENTS

| | | | | |
|---|---|---|---|---|
| 2014/0232955 | A1 | 8/2014 | Roudbari et al. | |
| 2017/0154591 | A1 | 6/2017 | Hung et al. | |
| 2019/0005873 | A1* | 1/2019 | Mao | G09G 3/3225 |
| 2019/0073955 | A1* | 3/2019 | Zou | G09G 3/3233 |

FOREIGN PATENT DOCUMENTS

| | | | |
|---|---|---|---|
| CN | 103971654 | A | 8/2014 |
| CN | 104200778 | A | 12/2014 |
| CN | 105679264 | A | 6/2016 |
| CN | 106782359 | A | 5/2017 |
| CN | 107393498 | A | 11/2017 |
| CN | 108777130 | A | 11/2018 |
| CN | 110176214 | A | 8/2019 |
| CN | 110738974 | A | 1/2020 |

* cited by examiner

*Primary Examiner* — Van N Chow
(74) *Attorney, Agent, or Firm* — Mark M. Friedman

(57) ABSTRACT

A pixel driving circuit, a driving method thereof and a liquid crystal display panel are provided. The pixel driving circuit comprising a compensating module which is connected to a driving transistor of a data-inputting module, the compensating module is configured to receive present stage scan signals and previous scan signals and to control the driving transistor to turn on with voltages generated by coupling the present stage scan signals and the previous scan signals to the driving transistor, thus coupling data signals to a first node. Based on this, a dynamic power consumption of the liquid crystal display panel can be reduced.

16 Claims, 4 Drawing Sheets

PIXEL DRIVING CIRCUIT, DRIVING METHOD THEREOF AND LIQUID CRYSTAL DISPLAY PANEL

BACKGROUND OF INVENTION

Field of Invention

The present invention relates to the field of display technology, and particularly to a pixel driving circuit, a driving method thereof and a liquid crystal display panel equipped with the pixel driving circuit.

Description of Prior Art

As shown in FIG. 1, a traditional pixel driving circuit 10 comprises a transistor T1, a storage capacitor Cst1 and a liquid crystal capacitor LC, a control terminal of the transistor T1 receives scan signals G(n) from a present stage scan line, the transistor T1 turns on under the control of the scan signals G(n), an input terminal of the transistor T1 receives data signals Data and transmits the data signals Data to a first node M via an output terminal of the transistor T1, an electrode plate of the storage capacitor Cst1 is connected to the first node M, another electrode plate of the storage capacitor Cst1 is connected to the ground, an electrode plate of the liquid crystal capacitor LC connects to the first node M, and another electrode plate of the storage capacitor Cst1 receives common voltage Vcom, the storage capacitor Cst1 and the liquid crystal capacitor LC drive pixels to display with voltages generated by coupling the data signals Data to the first node M.

With advantages of short response times, simple manufacturing processes, and wide viewing angles, blue phase liquid crystals (BP-LC) have captured attention from more and more in-house researchers around the world. However, a display panel equipped with the blue phase liquid crystals needs to drive the blue phase liquid crystals with higher driving voltages. It is generally believed that voltages of the data signals Data need to be higher than 30V which will cause voltages of the scan signals G(n) to go as high as 35V. According to a formula $P=fcV^2$ for dynamic power consumption of a liquid crystal display panel, wherein the P represents a dynamic power consumption, the f represents a display frequency of an image, the c represents a capacitance and the V represents a voltage of the scan signal G(n), the dynamic power consumption of the liquid crystal display panel exponentially increases as the voltages of the scan signals G(n) increase. Higher voltages of the scan signals G(n) will cause higher dynamic power consumption of the liquid crystal display panel beyond doubt.

SUMMARY OF INVENTION

The existed liquid crystal display panel has high dynamic power consumption.

The present invention provides a pixel driving circuit, comprising:

a data-inputting module comprising a driving transistor configured to receive data signals and couple the received data signals to a first node when the driving transistor turns on;

a compensating module connected to a control terminal of the driving transistor is configured to receive present stage scan signals and previous stage scan signals and to control the driving transistor to turn on with voltages generated by coupling the present stage scan signals and the previous stage scan signals to the control terminal of the driving transistor;

a storage capacitor; and a liquid crystal capacitor;

wherein the storage capacitor and the liquid crystal capacitor are connected to the first node, and the storage capacitor and the liquid crystal capacitor are configured to drive pixels to display with voltages generated by coupling the data signals to the first node.

The present invention also provides a driving method of a pixel driving circuit, comprising:

providing a pixel driving circuit comprising a data-inputting module, a compensating module, a storage capacitor and a liquid crystal capacitor, wherein the data-inputting module comprises a driving transistor, the compensating module is connected to a control terminal of the driving transistor, the driving transistor is connected to a first node, the storage capacitor and the liquid crystal capacitor are connected to the first node;

the compensating module receiving present stage scan signals and previous stage scan signals and controlling the driving transistor to turn on with voltages generated by coupling the present stage scan signals and the previous stage scan signals to the control terminal of the driving transistor;

the data-inputting module receiving data signals and coupling the received data signals to the first node when the driving transistor turns on;

the storage capacitor and the liquid crystal capacitor driving pixels to display with voltages generated by coupling the data signals to the first node.

The present invention also provides a liquid crystal display panel comprising a pixel driving circuit, wherein the pixel driving circuit comprises:

a data-inputting module comprising a driving transistor configured to receive data signals and couple the received data signals to a first node when the driving transistor turns on;

a compensating module connected to a control terminal of the driving transistor, is configured to receive present stage scan signals and previous stage scan signals and to control the driving transistor to turn on with voltages generated by coupling the present stage scan signals and the previous stage scan signals to the control terminal of the driving transistor;

a storage capacitor; and a liquid crystal capacitor;

wherein the storage capacitor and the liquid crystal capacitor are connected to the first node, and the storage capacitor and the liquid crystal capacitor are configured to drive pixels to display with voltages generated by coupling the data signals to the first node.

In the present invention, the pixel driving circuit connects to the control terminal of the driving transistor through the compensating module, the compensating module is configured to receive the present stage scan signals and the previous stage scan signals and to control the driving transistor to turn on with voltages generated by coupling the present stage scan signals and the previous stage scan signals to the control terminal of the driving transistor, namely, introducing the previous stage scan signals and combining the present stage scan signals with the previous stage scan signals to control the driving transistor. According to the formula $P=fcV^2$ for dynamic power consumption of the liquid crystal display panel, the dynamic power consumption of the liquid crystal display panel decreases as the voltages of the present stage scan signals decrease.

DETAILED DESCRIPTION OF PREFERRED EMBODIMENTS

This following description will illustrate a technical solution of the embodiments of the present invention clearly and completely with figures. Obviously, the embodiments described herein represent only a part of, but not all of the embodiments the present invention may include. All other embodiments attained by those skilled in the art basing on the embodiments of the present invention without inventive work are within the protection scope of the present invention. Any of the following embodiments and characteristics thereof can be combined if there is no conflict.

Figure 1:
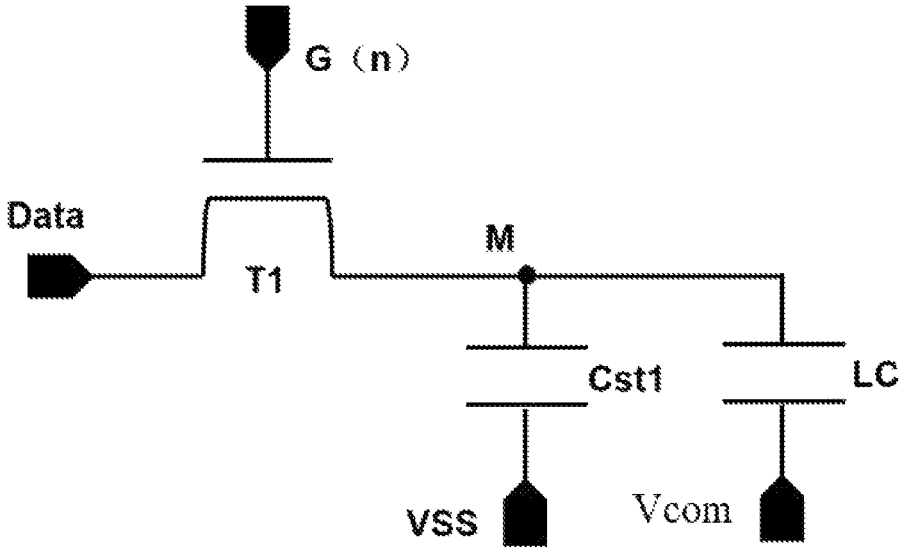
FIG. 1 is an equivalent diagram of a current pixel driving circuit.
Figure 2:
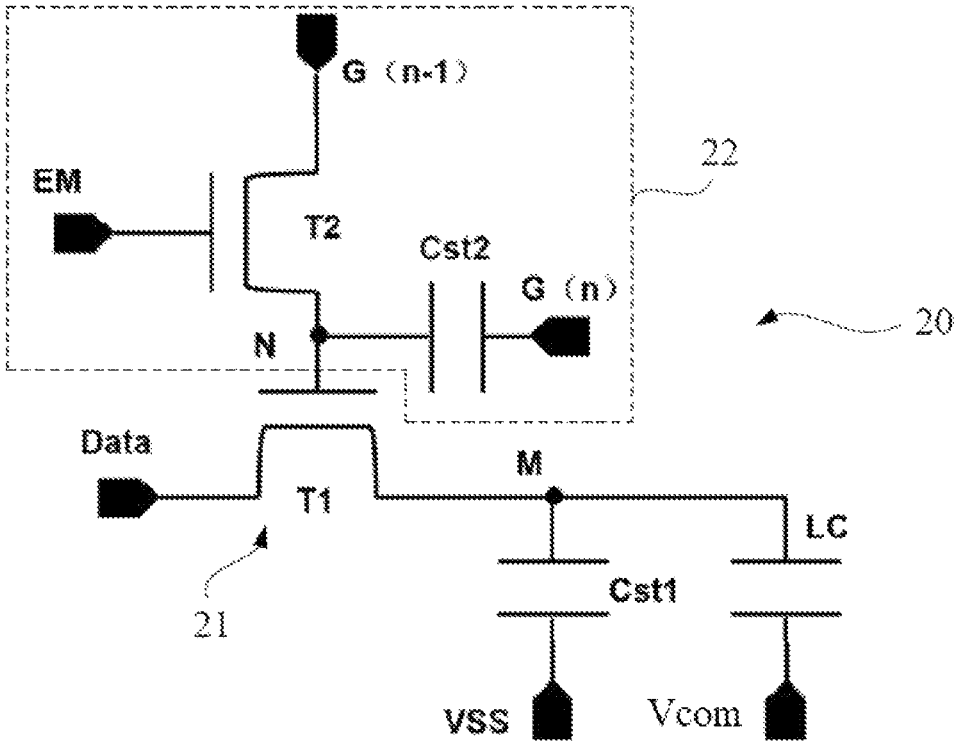
FIG. 2 is an equivalent diagram of a pixel driving circuit in an embodiment of the present invention.

FIG. 2 is an equivalent diagram of a pixel driving circuit in an embodiment of the present invention. As shown in FIG. 2, the pixel driving circuit 20 provided in the present embodiment comprises a data-inputting module 21, a compensating module 22, a storage capacitor Cst1 and a liquid crystal capacitor LC.

The data-inputting module 21 comprises a driving transistor T1.

The compensating module 22 is connected to a control terminal of the driving transistor T1, the compensating module 22 is configured to receive present stage scan signals G(n) and previous stage scan signals G(n−1) and to control the driving transistor T1 to turn on with voltages generated by coupling the present stage scan signals G(n) and the previous stage scan signals G(n−1) to the control terminal of the driving transistor T1.

The data-inputting module 21 is configured to receive data signals Data and couple the received data signals Data to a first node M when the driving transistor T1 turns on.

The storage capacitor Cst1 and the liquid crystal capacitor LC are connected to the first node M, and the storage capacitor Cst1 and the liquid crystal capacitor LC are configured to drive pixels to display with voltages generated by coupling the data signals to the first node M.

The pixel driving circuit 20 is connected to the control terminal of the driving transistor T1 through the compensating module 22, the compensating module 22 is configured to receive the present stage scan signals G(n) and the previous stage scan signals G(n−1) and to control the driving transistor T1 to turn on with voltages generated by coupling the present stage scan signals G(n) and the previous stage scan signals G(n−1) to the control terminal of the driving transistor T1, namely, introduce the previous stage scan signals G(n−1) and combine the present stage scan signals G(n) with the previous stage scan signals G(n−1) to control the driving transistor T1. According to the formula $P=fcV^2$ for dynamic power consumption of the liquid crystal display panel, wherein the P represents a dynamic power consumption of a liquid crystal display panel equipped with the pixel driving circuit 20, the f represents a display frequency of an image displayed in the liquid crystal display panel, the c represents a capacitance and the V represents a voltage of the present stage scan signal G(n), the dynamic power consumption of the liquid crystal display panel decreases as the voltages of the present stage scan signals G(n) decrease. The liquid crystal display panel in the embodiments of the present invention can also reduce its dynamic power consumption even though it is equipped with blue phase liquid crystals (BP-LCs).

The driving transistor T1 can be exemplified as either a P-type transistor or an N-type transistor. In addition, the driving transistor T1 can be exemplified as either a metal-oxide-semiconductor field-effect transistor (MOS) or a thin film transistor (TFT).

Further, the driving transistor T1 can be exemplified as either an amorphous silicon thin film transistor or a low temperature poly-silicon thin film transistor provided that the driving transistor T1 is a thin film transistor, the driving transistor T1 is not limited to a specific example herein.

Refer to FIG. 2, the compensating module 22 comprises a transistor T2 and a capacitor Cst2 in an embodiment of the present invention. The transistor T2 can be viewed as a second transistor T2 if the driving transistor T1 is viewed as a first transistor T1. A control terminal of the transistor T2 is configured to receive enable signals EM, an input terminal of the transistor T2 is configured to receive the previous stage scan signals G(n−1), an output terminal of the transistor T2 is connected to the control terminal of the driving transistor T1.

The capacitor Cst2 can be viewed as a second capacitor Cst2 if the storage capacitor Cst1 can be viewed as a first capacitor Cst1. An electrode plate of the capacitor Cst2 is connected to the control terminal of the driving transistor T1, another electrode plate of the capacitor Cst2 is configured to receive the present stage scan signals G(n).

In another aspect, the output terminal of the transistor T2 is connected to a second node N, an electrode plate of the capacitor Cst2 is connected to the second node N, the control terminal of the driving transistor T1 is connected to the second node N, the control terminal of the driving transistor T1 is controlled by voltages of the second node N whereas the voltages of the second node N are controlled by a combination of voltages of the present stage scan signals G(n) and the previous stage scan signals G(n−1).

Provided that the driving transistor T1 and the transistor T2 are both thin film transistors, the control terminal of the transistor T2 is a gate electrode, the input terminal of the transistor T2 is a source electrode and an output terminal of the transistor T2 is a drain electrode, the control electrode of the driving transistor T1 is a gate electrode, the input terminal of the driving transistor T1 is a source electrode and the output electrode of the driving transistor T1 is a drain electrode.

The input terminal of the driving transistor T1 is configured to receive the data signals Data and the output terminal of the driving transistor T1 is connected to the first node M.

An electrode plate of the capacitor Cst1 is connected to the first node M and another electrode plate of the capacitor Cst1 is connected to a ground VSS.

An electrode plate of the liquid crystal capacitor LC is connected to the first node M and another electrode plate of the liquid crystal capacitor LC is configured to receive a common voltage Vcom.

Figure 3:
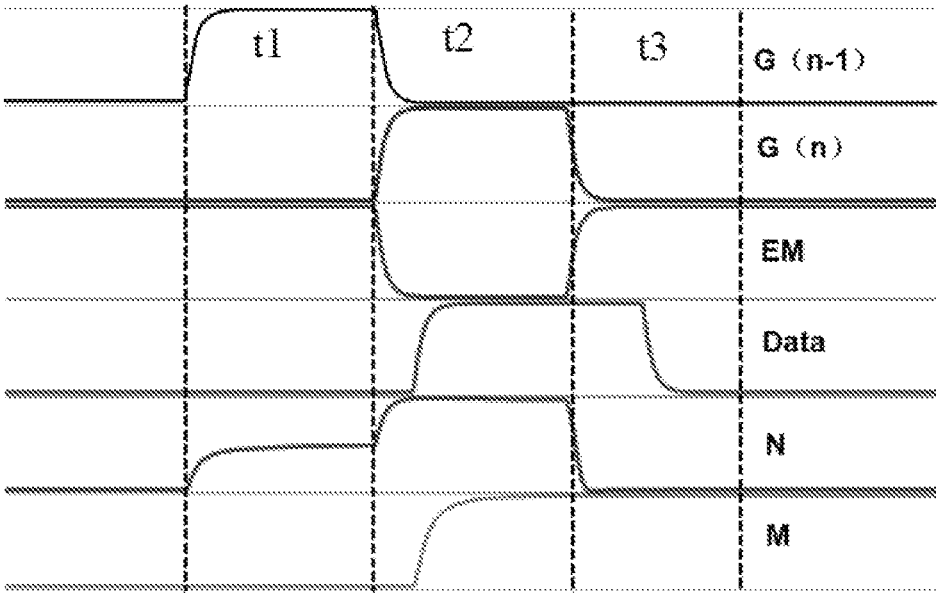
FIG. 3 is a sequence diagram of the pixel driving circuit as shown in FIG. 2.

Refer to FIG. 3, a driving process of the pixel driving circuit 20 in an embodiment of the present invention is divided into 3 stages:

First stage t1: the previous stage scan signals G(n−1) rise to a high voltage, while the enable signals EM are at a high voltage, the second node N is at a high voltage, the driving transistor T1 turns on, the first node M inputs a previous row's data signals Data.

Second stage t2: the previous stage scan signals G(n−1) reduce to a low voltage, while the transistor T2 turns off, the present stage scan signals G(n) rise from a low voltage to a high voltage, as the capacitor Cst2 exists, according to the principle of charge conservation, the second node N couples to a higher voltage, a present row's data signals Data writes into the first node M.

Third stage t3: The present stage scan signals G(n) reduce to a low voltage, while the enable signals EM rise to a high voltage, the transistor T2 turns on, as the previous stage scan signals G(n−1) are at a low voltage, the second node N reduces to a low voltage, the driving transistor T1 turns off, the first node M remains at a high voltage.

In practice, if a voltage of the data signal Data is required to be higher than 30V, high voltages of the present stage scan signal G(n) and the previous scan signals G(n−1) as well as the enable signals EM are all 15V, which are far less than 35V in the existing pixel driving circuit, according to the formula $P=fcV^2$, a dynamic power consumption of these three signals combined is far less than that of a traditional pixel driving circuit.

Figure 4:
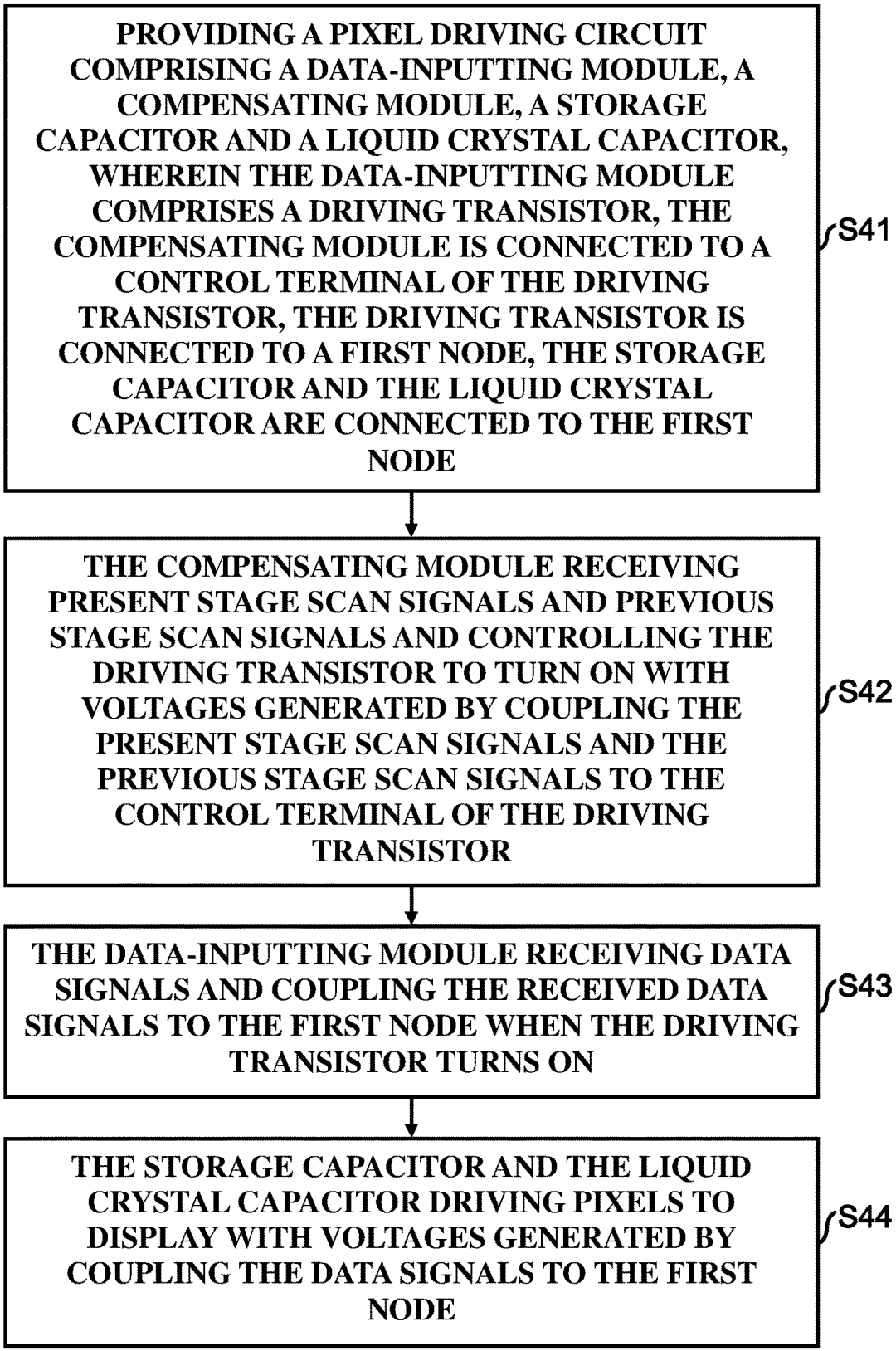
FIG. 4 is a flow chart of a driving method of a pixel driving circuit in an embodiment of the present invention.

FIG. 4 is a flow chart of a driving method of a pixel driving circuit of an embodiment of the present invention. Refer to FIG. 4, the driving method comprises the following steps S41-S44.

S41: providing a pixel driving circuit comprising a data-inputting module, a compensating module, a storage capacitor and a liquid crystal capacitor, wherein the data-inputting module comprises a driving transistor, the compensating module is connected to a control terminal of the driving transistor, the driving transistor is connected to a first node, the storage capacitor and the liquid crystal capacitor are connected to the first node;

S42: the compensating module receiving the present stage scan signals and the previous stage scan signals and controlling the driving transistor to turn on with voltages generated by coupling the present stage scan signals and the previous stage scan signals to the control terminal of the driving transistor;

S43: the data-inputting module receiving data signals and coupling the received data signals to the first node when the driving transistor turns on;

S44: the storage capacitor and the liquid crystal capacitor driving pixels to display with voltages generated by coupling the data signals to the first node.

The driving method can be applied to control the pixel driving circuit 20 provided in the aforementioned embodiments to reduce dynamic power consumption. The principle and detailed processes of each step of the driving method, which are not described herein in detail, can take the aforementioned as a reference.

Embodiments of the present invention also provide a liquid crystal panel comprising the pixel driving circuit 20 provided in any one of aforementioned embodiments for reducing dynamic power consumption.

Figure 5:
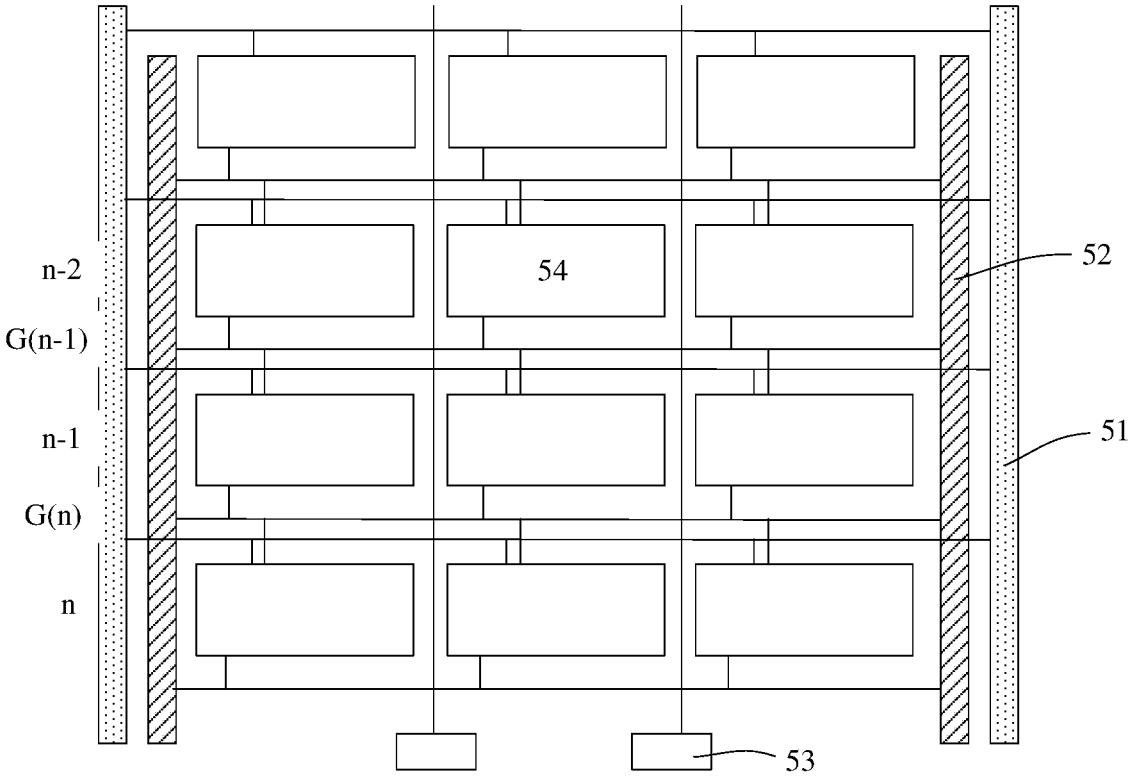
FIG. 5 is a structural schematic diagram of a pixel of a liquid crystal display panel in an embodiment of the present invention.

Refer to FIG. 5, in the liquid crystal display panel, the present stage scan signals G(n) can be provided by a gate driver on array (GOA) 52 through its n-th row scan line, pixels 54 of rows n−1 and n share the present stage scan signals G(n), the enable signals EM can be provided by a gate driver on array (GOA) 51, and the data signals Data can be provided by a chip on film or flex (COF) 53.

Though the present invention has been described by one or more of the above embodiments, those skilled in the art can make equivalent deformations and changes by reading and understanding the specification and figures of the present invention. The present invention which includes all of such changes and deformations can only be limited by the protection scope of the claims.

That is, disclosed above which shall not be viewed as any limitations to the protection scope of the present invention are embodiments of the present invention only. Any equivalent structure or process changes derived from the specification and figures of the present invention, for example, combinations of characteristics among the embodiments, application to other relevant fields directly or indirectly, shall be included within the protection scope of the present invention.

In the present invention, terms such as 'center', 'longitudinal', 'transverse', 'length', 'width', 'thickness', 'up', 'down', 'front', 'back', 'left', 'right', 'vertical', 'horizontal', 'top', 'bottom', 'internal', 'external', and so on instruct an orientation or a position relationship based on an orientation or a position relationship shown in the figures, which are for simplifying the description of the present invention instead of instructing or implying that a device or a component must include such a specific orientation, or a constitution or operation in a specific orientation, and therefore it shall not be understood as a limitation to the present invention. Besides, terms such as 'first', 'second' are for describing distinctively, and they can neither be understood as instructing or implying a relative importance, nor be understood as instructing a quantity of technical characteristics. Therefore, characteristics defined with 'first', 'second' can include one or more of characteristics either explicitly or implicitly. In the present invention, a term such as 'a plurality of' means two or more than two, except that it is defined explicitly and specifically.

In the present invention, the term of 'exemplify' is used for describing as an example. Any embodiments described with the term 'exemplify' shall not be explained as more preferred or advantageous than any other embodiments. The above description is given in the present invention to allow those skilled in the art to fulfill and apply the present invention. Those skilled in the art shall realize that the present invention can be fulfilled without some specific details listed to explain the present invention. Some prior arts are not described in detail to avoid an obscure in some other embodiments of the present invention. Therefore, the present invention shall be in accordance with the widest protection scope of the present invention rather than being limited by the aforementioned embodiments.

What is claimed is:

1. A pixel driving circuit, comprising:

a data-inputting module comprising a driving transistor configured to receive data signals and couple the received data signals to a first node when the driving transistor turns on;

a compensating module connected to a control terminal of the driving transistor is configured to receive present stage scan signals and previous stage scan signals and to control the driving transistor to turn on with voltages generated by coupling the present stage scan signals and the previous stage scan signals to the control terminal of the driving transistor, wherein the compensating module comprises a transistor and a capacitor, a control terminal of the transistor is configured to receive enable signals, an input terminal of the transistor is configured to receive the previous stage scan signals, an output terminal of the transistor is connected to the control terminal of the driving transistor, an electrode plate of the capacitor is connected to the control terminal of the driving transistor, and another electrode plate of the capacitor is configured to receive the present stage scan signals;

a storage capacitor; and a liquid crystal capacitor;

wherein the storage capacitor and the liquid crystal capacitor are connected to the first node, and the storage capacitor and the liquid crystal capacitor are configured to drive pixels to display with voltages generated by coupling the data signals to the first node.

2. The pixel driving circuit of claim 1, wherein the control terminal of the transistor is a gate electrode, the input terminal of the transistor is a source electrode and the output terminal of the transistor is a drain electrode.

3. The pixel driving circuit of claim 1, wherein an input terminal of the driving transistor is configured to receive the data signals and an output terminal of the driving transistor is connected to the first node.

4. The pixel driving circuit of claim 3, wherein the control terminal of the driving transistor is a gate electrode, the input terminal of the driving transistor is a source electrode, and the output terminal of the driving transistor is a drain electrode.

5. The pixel driving circuit of claim 1, wherein an electrode plate of the storage capacitor is connected to the first node and another electrode plate of the storage capacitor is connected to the ground.

6. The pixel driving circuit of claim 1, wherein an electrode plate of the liquid crystal capacitor is connected to the first node and another electrode plate of the liquid crystal capacitor is configured to receive a common voltage.

7. A driving method of a pixel driving circuit, comprising:

providing a pixel driving circuit comprising a data-inputting module, a compensating module, a storage capacitor and a liquid crystal capacitor, wherein the data-inputting module comprises a driving transistor, the compensating module is connected to a control terminal of the driving transistor wherein the compensating module comprises a transistor and a capacitor, a control terminal of the transistor is configured to receive enable signals, an input terminal of the transistor is configured to receive the previous stage scan signals, an output terminal of the transistor is connected to the control terminal of the driving transistor, an electrode plate of the capacitor is connected to the control terminal of the driving transistor, and another electrode plate of the capacitor is configured to receive the present stage scan signals, the driving transistor is connected to a first node, the storage capacitor and the liquid crystal capacitor are connected to the first node;

the compensating module receiving present stage scan signals and previous stage scan signals and controlling the driving transistor to turn on with voltages generated by coupling the present stage scan signals and the previous stage scan signals to the control terminal of the driving transistor;

the data-inputting module receiving data signals and coupling the received data signals to the first node when the driving transistor turns on;

the storage capacitor and the liquid crystal capacitor driving pixels to display with voltages generated by coupling the data signals to the first node.

8. The driving method of claim 7, wherein an input terminal of the driving transistor is configured to receive the data signals and an output terminal of the driving transistor is connected to the first node.

9. The driving method of claim 7, wherein an electrode plate of the storage capacitor is connected to the first node and another electrode plate of the storage capacitor is connected to the ground.

10. The driving method of claim 7, wherein an electrode plate of the liquid crystal capacitor is connected to the first node and another electrode plate of the liquid crystal capacitor receiving a common voltage.

11. A liquid crystal display panel comprising a pixel driving circuit, wherein the pixel driving circuit comprises:

a data-inputting module comprising a driving transistor configured to receive data signals and couple the received data signals to a first node when the driving transistor turns on;

a compensating module connected to a control terminal of the driving transistor, is configured to receive present stage scan signals and previous stage scan signals and to control the driving transistor to turn on with voltages generated by coupling the present stage scan signals and the previous stage scan signals to the control terminal of the driving transistor, wherein the compensating module comprises a transistor and a capacitor, a control terminal of the transistor is configured to receive enable signals, an input terminal of the transistor is configured to receive the previous stage scan signals, an output terminal of the transistor is connected to the control terminal of the driving transistor, an electrode plate of the capacitor is connected to the control terminal of the driving transistor, and another electrode plate of the capacitor is configured to receive the present stage scan signals;

a storage capacitor; and a liquid crystal capacitor;

wherein the storage capacitor and the liquid crystal capacitor are connected to the first node, and the storage capacitor and the liquid crystal capacitor are configured to drive pixels to display with voltages generated by coupling the data signals to the first node.

12. The liquid crystal display panel of claim 11, wherein the control terminal of the transistor is a gate electrode, the input terminal of the transistor is a source electrode and the output terminal of the transistor is a drain electrode.

13. The liquid crystal display panel of claim 11, wherein an input terminal of the driving transistor is configured to receive the data signals and an output terminal of the driving transistor is connected to the first node.

14. The liquid crystal display panel of claim 13, wherein the control terminal of the driving transistor is a gate electrode, the input terminal of the driving transistor is a source electrode and the output terminal of the driving transistor is a drain electrode.

15. The liquid crystal display panel of claim 11, wherein an electrode plate of the storage capacitor is connected to the first node and another electrode plate of the storage capacitor is connected to the ground.

16. The liquid crystal display panel of claim 11, wherein an electrode plate of the liquid crystal capacitor is connected to the first node and another electrode plate of the liquid crystal capacitor is configured to receive a common voltage.

* * * * *